US011802568B2

(12) United States Patent
Takeda et al.

(10) Patent No.: US 11,802,568 B2
(45) Date of Patent: Oct. 31, 2023

(54) VACUUM THREAD-GROOVE PUMP WITH THREAD EXHAUST CHANNELS

(71) Applicant: Edwards Japan Limited, Chiba (JP)

(72) Inventors: Shunsuke Takeda, Chiba (JP); Yoshiyuki Sakaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 6 days.

(21) Appl. No.: 17/625,974

(22) PCT Filed: Jul. 10, 2020

(86) PCT No.: PCT/JP2020/027129

§ 371 (c)(1),
(2) Date: Jan. 10, 2022

(87) PCT Pub. No.: WO2021/010347

PCT Pub. Date: Jan. 21, 2021

(65) Prior Publication Data

US 2022/0260080 A1 Aug. 18, 2022

(30) Foreign Application Priority Data

Jul. 17, 2019 (JP) ..... 2019-131945

(51) Int. Cl.
*F04D 19/04* (2006.01)

(52) U.S. Cl.
CPC ..... *F04D 19/042* (2013.01); *F04D 19/044* (2013.01); *F05D 2210/12* (2013.01); *F05D 2260/607* (2013.01)

(58) Field of Classification Search
None
See application file for complete search history.

(56) References Cited

U.S. PATENT DOCUMENTS 4,541,772 A * 9/1985 Becker ..... F04D 19/042 310/90.5
5,166,566 A * 11/1992 Bernhardt ..... F16C 32/0442 310/90

(Continued)

FOREIGN PATENT DOCUMENTS

EP 3263905 A1 * 1/2018 ..... F04C 18/126
JP H09310696 A 12/1997

(Continued)

OTHER PUBLICATIONS

PCT International Search Report dated Sep. 8, 2020 for corresponding PCT application Serial No. PCT/JP2020/027129, 2 pages.

(Continued)

*Primary Examiner* — Bryan M Lettman
*Assistant Examiner* — Geoffrey S Lee
(74) *Attorney, Agent, or Firm* — Theodore M. Magee; Westman, Champlin & Koehler, P.A.

(57) ABSTRACT

A vacuum pump includes a linked-type thread-groove spacer which is a structure for linking a Siegbahn pump portion and a thread-groove pump portion, and when an outlet position of a thread groove which is an exhaust channel portion of this linked-type thread-groove spacer is in a vicinity of the stator portion (stator bolt) of the stator column, conductance of the exhaust channel is lowered. Thus, phases in a circumferential direction of installation positions of a thread ridge of the linked-type thread-groove spacer and the stator portion of the stator column are aligned as much as possible. In other words, the thread groove of the linked-type thread-groove spacer which is the exhaust channel is provided between the installation positions of the stator portions in the circumferential direction of the stator column so that lowering of the conductance of the exhaust channel is suppressed.

2 Claims, 5 Drawing Sheets

(56) References Cited

U.S. PATENT DOCUMENTS

| | | | | |
|---|---|---|---|---|
| 7,572,096 | B2 * | 8/2009 | Nonaka | F04D 19/04 415/200 |
| 2001/0012488 | A1 * | 8/2001 | Ohtachi | F04D 19/04 417/423.4 |
| 2003/0095860 | A1 * | 5/2003 | Takamine | F04D 19/04 415/90 |
| 2017/0002832 | A1 * | 1/2017 | Nonaka | F04D 29/545 |
| 2020/0011336 | A1 * | 1/2020 | Mitsuhashi | F04D 29/058 |
| 2020/0092952 | A1 * | 3/2020 | Ohtachi | F04D 19/042 |
| 2022/0228594 | A1 * | 7/2022 | Saegusa | F04D 19/044 |

FOREIGN PATENT DOCUMENTS

| | | | |
|---|---|---|---|
| JP | 2015143513 | A | 8/2015 |
| JP | 2017106365 | A | 6/2017 |
| JP | 2017137840 | A | 8/2017 |

OTHER PUBLICATIONS

PCT International Written Opinion dated Sep. 8, 2020 for corresponding PCT application Serial No. PCT/JP2020/027129, 4 pages.

* cited by examiner

VACUUM THREAD-GROOVE PUMP WITH THREAD EXHAUST CHANNELS

CROSS-REFERENCE OF RELATED APPLICATION

This application is a Section 371 National Stage Application of International Application No. PCT/JP2020/027129, filed Jul. 10, 2020, which is incorporated by reference in its entirety and published as WO 2021/010347A1 on Jan. 21, 2021 and which claims priority of Japanese Application No. 2019-131945, filed Jul. 17, 2019.

BACKGROUND

The present invention relates to a vacuum pump having a thread-groove pump portion (cylindrical thread portion) or particularly the thread-groove pump portion and a Siegbahn pump portion, in which, in a structure where an outlet of the thread-groove pump portion is located in a vicinity of a stator portion of a stator column, lowering of an exhaust performance is suppressed, while strength is maintained.

A Holbeck-type molecular pump having a Holbeck-type thread-groove exhaust element which has been used conventionally includes a rotating cylindrical portion and a stator cylindrical portion installed with a gap (clearance) from the rotating cylindrical portion in a radial direction, and a spiral groove channel is engraved in at least either one of clearance opposed surfaces of the rotating cylindrical portion and the stator cylindrical portion.

And it is so constituted that, when this rotating cylindrical portion is rotated at a high speed, a compressed exhaust gas flows into the spiral groove channel and is exhausted from an outlet while being guided by this spiral groove channel.

As shown in FIG. 5, in a vacuum pump 1001 having the Holbeck-type molecular pump portion as above, a stator portion (stator bolt 800) of a stator column 80 accommodating various electric components is present on an inner side of a rotor cylindrical portion 10.

By the way, further improvement in performances of the vacuum pump has been requested in recent years, and a rotation speed of the rotor has been increased from approximately 27000 rotations/minute to 30000 rotations/minute to approximately 36000 rotations/minute to 37000 rotations/minute.

When the rotation speed of the rotor is increased as above, a high stress by a centrifugal force is generated in the rotor with that. At the same time, since a high stress is generated also in the rotor cylindrical portion, constitution with material which can bear the high stress as much as possible is in demand. Moreover, from a viewpoint of stress resistance, a diameter of the rotor cylindrical portion in the radial direction also needs to be decreased.

In an example shown in FIG. 5, a reinforcing ring 300 is provided on an outer periphery of the rotor cylindrical portion 10 so that the rotor cylindrical portion 10 can bear the centrifugal force by high-speed rotation.

Here, if the diameter of the rotor cylindrical portion 10 in the radial direction is decreased, an outlet position of the thread groove, which is a spiral groove in design, should be brought close to the stator portion of the stator column 80. Thus, interference with the gas exhaust occurs, and an exhaust channel becomes narrower (lowering of conductance of the exhaust channel) and as a result, there was a concern that the exhaust performance of the vacuum pump is badly affected.

Japanese Patent Application Publication No. 2017-106365 discloses a linked-type thread-groove spacer, which realizes size reduction while the exhaust performance of the thread-groove pump portion is maintained, and a vacuum pump in which the linked-type thread-groove spacer is disposed. That is, the described linked-type thread-groove spacer includes a structure for linking the Siegbahn pump portion and the thread-groove pump portion, and a structure of the thread-groove pump portion which is an exhaust element portion is constituted such that a Siegbahn-type structure is mounted on a cylindrical thread, and each component is linked at the mounting portion. That is, a boundary in the channel between the Siegbahn portion and the cylindrical thread (thread-groove pump portion) is connected substantially at a right angle when seen from an axis direction of the vacuum pump so as to connect the Siegbahn portion and the channel of the thread-groove pump portion. By means of this constitution, a compression channel length of the thread-groove pump portion is extended by the linked Siegbahn portion in the radial direction.

The discussion above is merely provided for general background information and is not intended to be used as an aid in determining the scope of the claimed subject matter. The claimed subject matter is not limited to implementations that solve any or all disadvantages noted in the background.

SUMMARY

However, the above-described Japanese Patent Application Publication No. 2017-106365 did not consider the lowering of conductance of the exhaust channel when the outlet position of the thread groove gets closer to the stator portion of the stator column by decreasing the diameter of the rotor cylindrical portion in the radial direction.

Regarding this lowered conductance of the exhaust channel, if a clearance between the outlet position of the thread groove and the stator portion of the stator column is to be taken large, a dimension of the vacuum pump in a height direction becomes large, which contradicts the demand for a compact vacuum pump.

Alternatively, such methods can be considered that a thickness of the stator portion of the stator column is decreased, a counter-boring shape is used, or the number of bolts used in the stator portion is decreased so as to take a large clearance and to secure the conductance of the exhaust channel. However, a problem of strength of the stator portion in the stator column is inevitably generated.

Thus, the present invention has an object to provide a vacuum pump in which, even if the diameter of the rotor cylindrical portion in the radial direction is decreased, a size in the height direction is not increased, the fixing strength of the stator portion of the stator column is not lowered, while the conductance of the exhaust channel is maintained, and the exhaust performance is not lowered.

An invention of the present application described in claim 1 provides a vacuum pump including:

- a housing in which an inlet port or an outlet port is formed;
- a stator column enclosed in the housing and surrounding various electric components;
- a rotating shaft rotatably supported inside the housing;
- a rotating body fixed to the rotating shaft and disposed on an outer side of the stator column and rotating with the rotating shaft; and
- a stator portion opposing the rotating body with a predetermined clearance and having a thread groove formed; and including:

a thread-groove pump portion which exhausts a gas by a mutual action between the rotating body which is rotated and the thread groove formed in the stator portion, characterized in that at least one of root portions, which is an outlet of a plurality of thread exhaust channels constituting the thread-groove pump portion, is disposed at a position not interfering with a stator member which fixes the stator column.

An invention of the present application characterized in that when at least one of the root portions, which is an outlet of the plurality of thread exhaust channels is disposed at a position not interfering with the stator member which fixes the stator column, the stator member is not disposed at the root portion which is the closest to the outlet port.

An invention of the present application described in claim 3 provides the vacuum pump described in claim 1, characterized in that root portions which are outlets of a plurality of thread exhaust channels constituting the thread-groove pump portion are disposed at positions not interfering with a stator member which fixes the stator column.

According to the present invention, even if the diameter of the rotor cylindrical portion in the radial direction is decreased, narrowing of the exhaust channel can suppress lowering of the exhaust performance of the vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

(i) Outline of Embodiment

Figure 1:
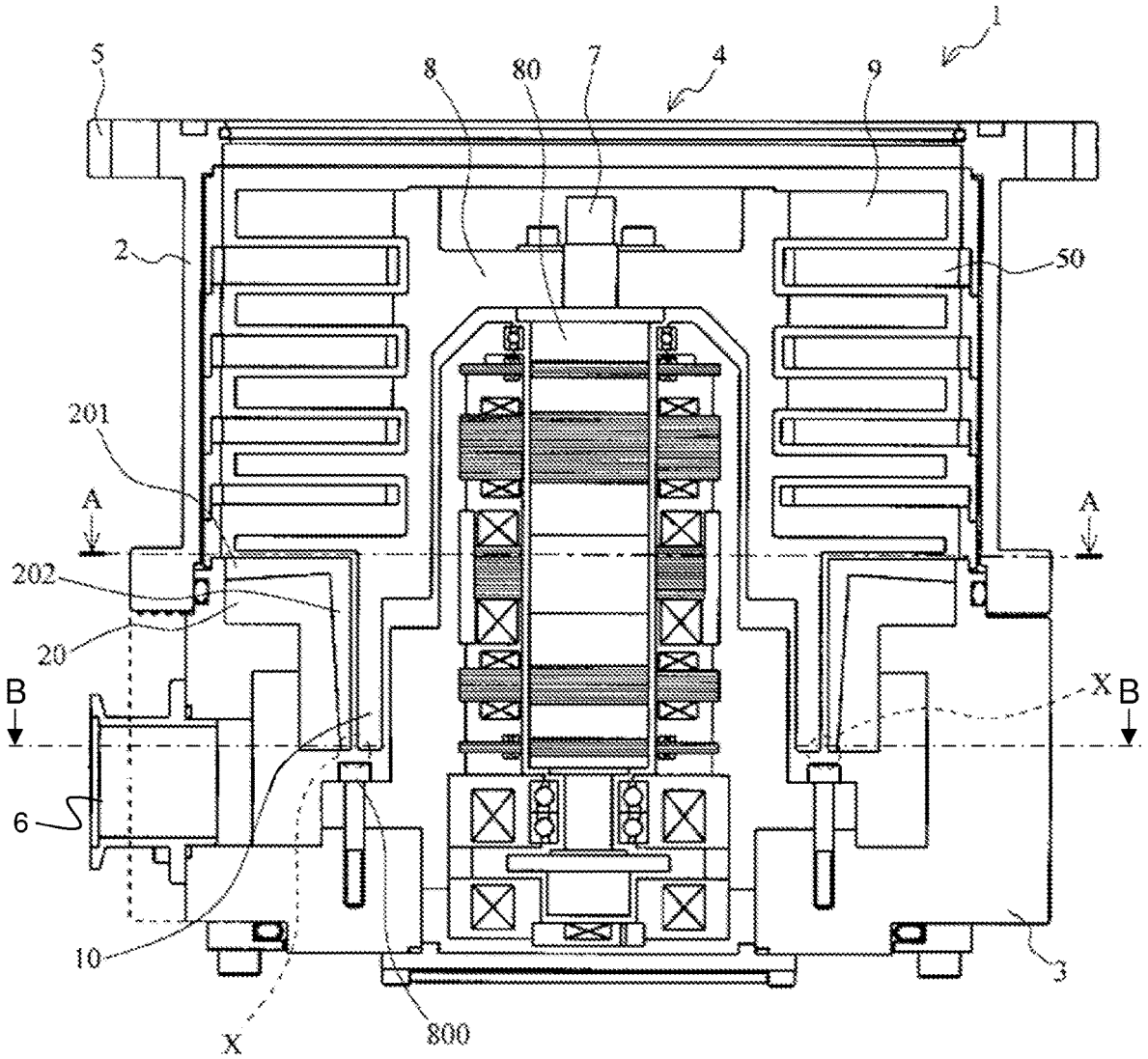
FIG. 1 is a diagram illustrating a schematic constitution example of a vacuum pump according to an embodiment of the present invention.

A vacuum pump according to an embodiment of the present invention includes a linked-type thread-groove spacer which is a structure for linking a Siegbahn pump portion and a thread-groove pump portion. When an outlet position of a thread groove which is an exhaust channel portion (thread exhaust channel) of this linked-type thread-groove spacer is in a vicinity of a stator portion (stator bolt) of a stator column, conductance of the exhaust channel is lowered.

Thus, endings of thread ridges of the linked-type thread-groove spacer and the stator portion (stator bolt) of the stator column are aligned as much as possible. In other words, the thread groove of the linked-type thread-groove spacer which is the exhaust channel is provided between the installation positions of the stator portions (stator bolts) in the circumferential direction of the stator column. As a result, lowering of the conductance of the exhaust channel can be suppressed.

(ii) Details of Embodiment

The vacuum pump of the embodiment of the present invention has a thread-groove pump portion which includes a Siegbahn pump portion in which a spiral (spiral) groove having a ridge portion and a root portion is engraved (disposed) in at least either one of a disposed stator cylindrical portion and a disposed rotator cylindrical portion, and moreover, a thread-groove spacer having a spiral groove formed in an opposed surface to the rotating cylinder and opposed to an outer peripheral surface of the rotating cylinder with a predetermined clearance between them and is a gas transfer mechanism by which a gas is sent out while being guided by a thread groove (spiral groove) with rotation of the rotor cylinder by means of high-speed rotation of the rotating cylinder.

And the Siegbahn pump portion and the thread-groove pump portion are linked by the linked-type thread-groove spacer.

By the way, due to a demand for further improvement of an exhaust performance of the vacuum pump, a need to increase a rotation speed of the rotor of the vacuum pump is generated. At this time, a high stress generated by a centrifugal force by the above-described rotation speed and stress resistance (tension strength in general) of a material of the rotor need to be considered, and if a diameter of the rotor cylindrical portion in a radial direction is decreased, a position of the stator portion of the stator column should be brought closer to an outlet of the thread groove which is the spiral groove in some cases.

At this time, there is a concern that the stator portion (stator bolt) of the stator column hinders gas exhaust, narrows the exhaust channel, and badly affects the exhaust performance of the vacuum pump. Thus, the installation position of the stator portion (stator bolt) of the stator column and the installation position of the thread ridge on an outlet side of the linked-type thread-groove spacer are aligned as much as possible.

As a result, lowering of the exhaust performance of the vacuum pump due to narrowing of the exhaust channel of the vacuum pump can be prevented.

Hereinafter, a preferred embodiment of the present invention will be described in detail by referring to FIGS. 1 to 4.

FIG. 1 is a view illustrating a schematic constitution example of a vacuum pump 1 according to a first embodiment of the present invention and illustrates a sectional view of a vacuum pump 1 in an axis direction.

It is to be noted that, in the embodiment of the present invention, a diameter direction of a rotor blade is referred to as a "diameter (diameter/radial) direction" and a direction perpendicular to the diameter direction of the rotor blade as an "axis direction (or an axial direction)" in explanation for convenience.

A casing (outer cylinder) 2 forming a housing of the vacuum pump 1 has a substantially cylindrical shape and constitutes an enclosure of the vacuum pump 1 together with a base 3 provided on a lower part (outlet port 6 side) of the casing 2. And inside this enclosure, a gas transfer mechanism which is a structure causing the vacuum pump 1 to exert an exhaust function is accommodated.

In this embodiment, this gas transfer mechanism is roughly constituted by a rotating portion (rotor portion/Siegbahn portion) rotatably supported and a stator portion (thread-groove pump portion) fixed to the enclosure.

Moreover, though not shown, a control device which controls an operation of the vacuum pump 1 is connected outside the housing of the vacuum pump 1 via a dedicated line.

On an end portion of the casing 2, an inlet port 4 which introduces a gas into the vacuum pump 1 is formed. Moreover, on an end surface of the casing 2 on the inlet port 4 side, a flange portion 5 extended to an outer peripheral side is formed.

Furthermore, on the base 3, an outlet port 6 for exhausting the gas from the vacuum pump 1 is formed.

The rotating portion (rotating body) is constituted by a shaft 7 which is a rotating shaft, a rotor 8 disposed on this shaft 7, a plurality of rotor blades 9 provided on the rotor 8, and a rotor cylindrical portion 10 provided on the outlet port 6 side (thread-groove pump portion). It is to be noted that the rotor portion is constituted by the shaft 7 and the rotor 8.

Each of the rotor blades 9 is constituted by a blade radially extended perpendicularly to an axis of the shaft 7. It is to be noted that, in this embodiment, a lowermost stage (outlet port 6 side) of the rotor blade 9 has a disc shape and is constituted to compress the Siegbahn portion.

Moreover, the rotor cylindrical portion 10 is constituted by a cylindrical member having a cylindrical shape which is concentrical with a rotating axis of the rotor 8.

Approximately in the middle of the shaft 7 in the axis direction, a motor portion for rotating the shaft 7 at a high speed is provided and is enclosed in the stator column 80.

Moreover, in the stator column 80, a radial magnetic bearing device which supports the shaft 7 in the radial direction (radial direction) in a non-contact manner is provided on the inlet port 4 side and the outlet port 6 side of the shaft 7 with respect to the motor portion. Furthermore, on a lower end of the shaft 7, an axial magnetic bearing device which supports the shaft 7 in the axial direction in a non-contact manner in the axis (axial direction) is provided.

On an inner peripheral side of the enclosure (casing 2), a stator portion (stator component) is formed. This stator portion is constituted by a stator blade 50 and the like, and is constituted by blades extending from an inner peripheral surface of the casing 2 inclined only by a predetermined angle from a plane perpendicular to the axis of the shaft 7 toward the shaft 7. And the stator blades 50 are separated from each other by a spacer (stator component) having a cylindrical shape and fixed, and is constituted as a turbo-molecular pump portion (turbo-molecular pump stage).

It is to be noted that, in the above-described turbo-molecular pump portion, the rotor blades 9 and the stator blades 50 are disposed alternately and formed in multi-stages in the axis direction, but in order to satisfy the exhaust performance required for the vacuum pump, arbitrary numbers of rotor components and stator components can be provided as necessary.

Moreover, in this embodiment, a linked-type thread-groove spacer 20 having a thread-groove pump portion is disposed closer to the outlet port 6 side than the above-described turbo-molecular pump portion.

In the linked-type thread-groove spacer 20, a thread groove (spiral groove) is formed in an opposed surface to the rotor cylindrical portion 10 similarly to the conventional thread groove spacer.

An opposed surface side (that is, an inner peripheral surface in parallel to an axis of the vacuum pump 1) to the rotor cylindrical portion 10 in the linked-type thread-groove spacer 20 is opposed to the outer peripheral surface of the rotor cylindrical portion 10 with a predetermined clearance between them, and when the rotor cylindrical portion 10 is rotated at a high speed, it is constituted such that a gas compressed by the vacuum pump 1 is sent out to the outlet port 6 side while being guided by the thread groove with the rotation of the rotor cylindrical portion 10. That is, the thread groove is a channel which transports the gas.

As described above, by having the opposed surface to the rotor cylindrical portion 10 in the linked-type thread-groove spacer 20 to oppose the rotor cylindrical portion 10 with the predetermined clearance between them, the gas transfer mechanism which transfers the gas by the thread groove formed in the inner peripheral surface of the linked-type thread-groove spacer 20 in the axis direction is formed.

It is to be noted that, in order to reduce a force by which the gas counterflows to the inlet port 4 side, the smaller this clearance is, the more desirable it is.

Moreover, a direction of the spiral groove formed in the linked-type thread-groove spacer 20 is a direction toward the outlet port 6 when the gas is transported to a rotating direction of the rotor 8 in the spiral groove.

Furthermore, a depth of the spiral groove is constituted so as to be shallower as it goes closer to the outlet port 6, and the gas transported in the spiral groove is more compressed as it goes closer to the outlet port 6.

By means of the above-described constitution, in the vacuum pump 1, the gas sucked through the inlet port 4 is compressed by the Siegbahn portion and then, is further compressed by the thread-groove pump portion and is exhausted from the outlet port 6 and thus, the vacuum pump 1 can conduct vacuum exhaust treatment in a vacuum chamber (not shown) disposed in the vacuum pump 1.

Here, the stator column 80 is fixed to the base 3 by a stator bolt 800. A position of this stator bolt 800 is different from a position shown in FIG. 5. This is because, when rotation speeds of the rotor 8 and the rotor cylindrical portion 10 are increased, a diameter of the stator column 80 in the radial direction needs to be decreased, and the stator bolt 800 cannot be installed at the position shown in FIG. 5 in design.

Figure 5:
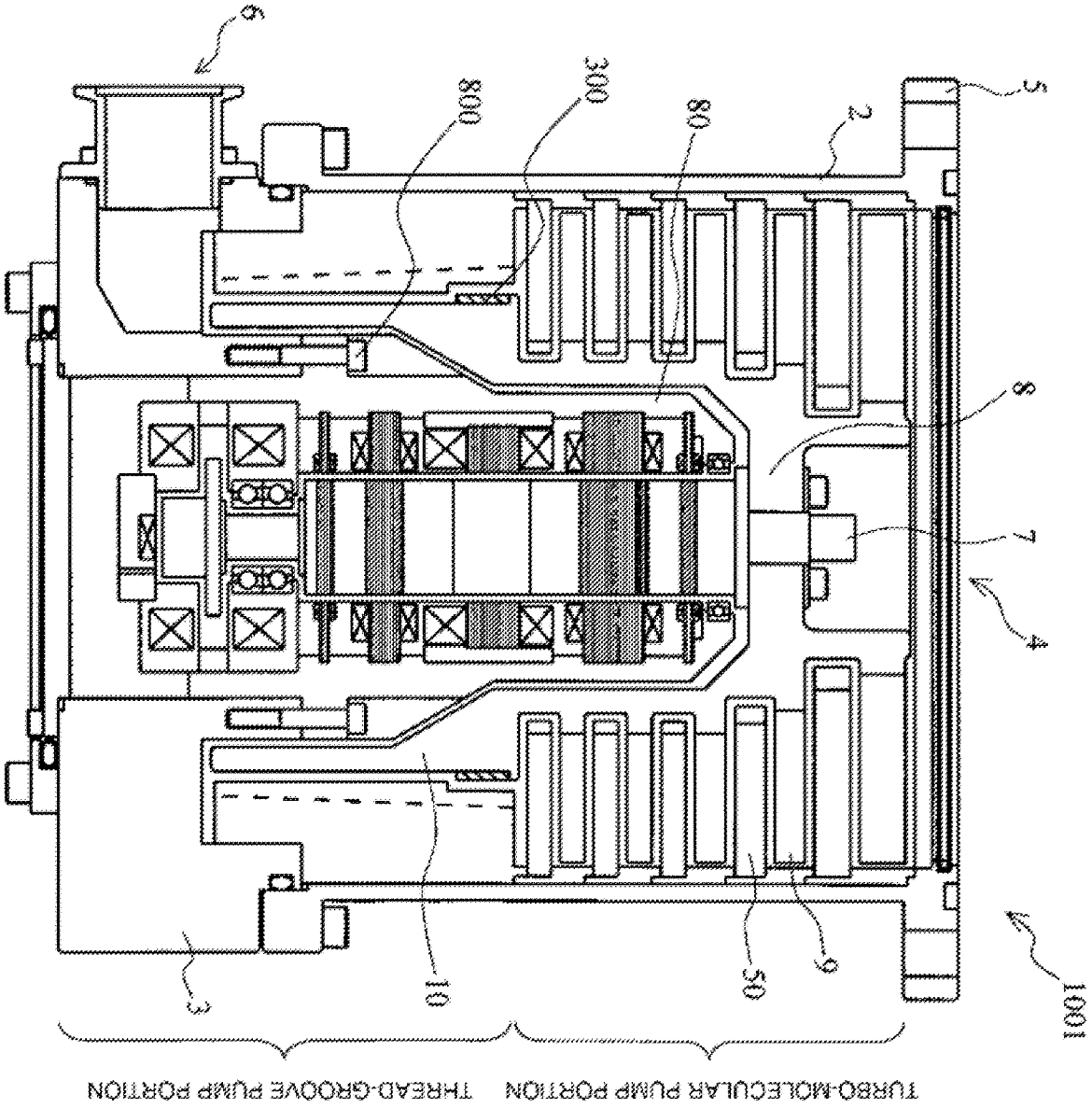
FIG. 5 is a view for explaining a rotor cylindrical portion and a stator bolt in a prior art.

Moreover, if the stator bolt 800 is installed at the position shown in FIG. 5, it becomes difficult to maintain sufficient strength in design.

As is obvious from this FIG. 1, if the stator bolt 800 is installed at the position shown in FIG. 1, it is a spot indicated by X in the figure which is proximate to an outlet of an exhaust gas of the linked-type thread-groove spacer. This stator bolt 800 is installed at plural spots (6 spots, 8 spots, 10 spots, for example) in a circumferential direction. Moreover, the outlets of the exhaust gas of the linked-type thread-groove spacer 20 are also present at plural spots in the circumferential direction due to a relationship between a ridge and a root (a root portion is an outlet of the exhaust gas) which are provided.

Figure 2:
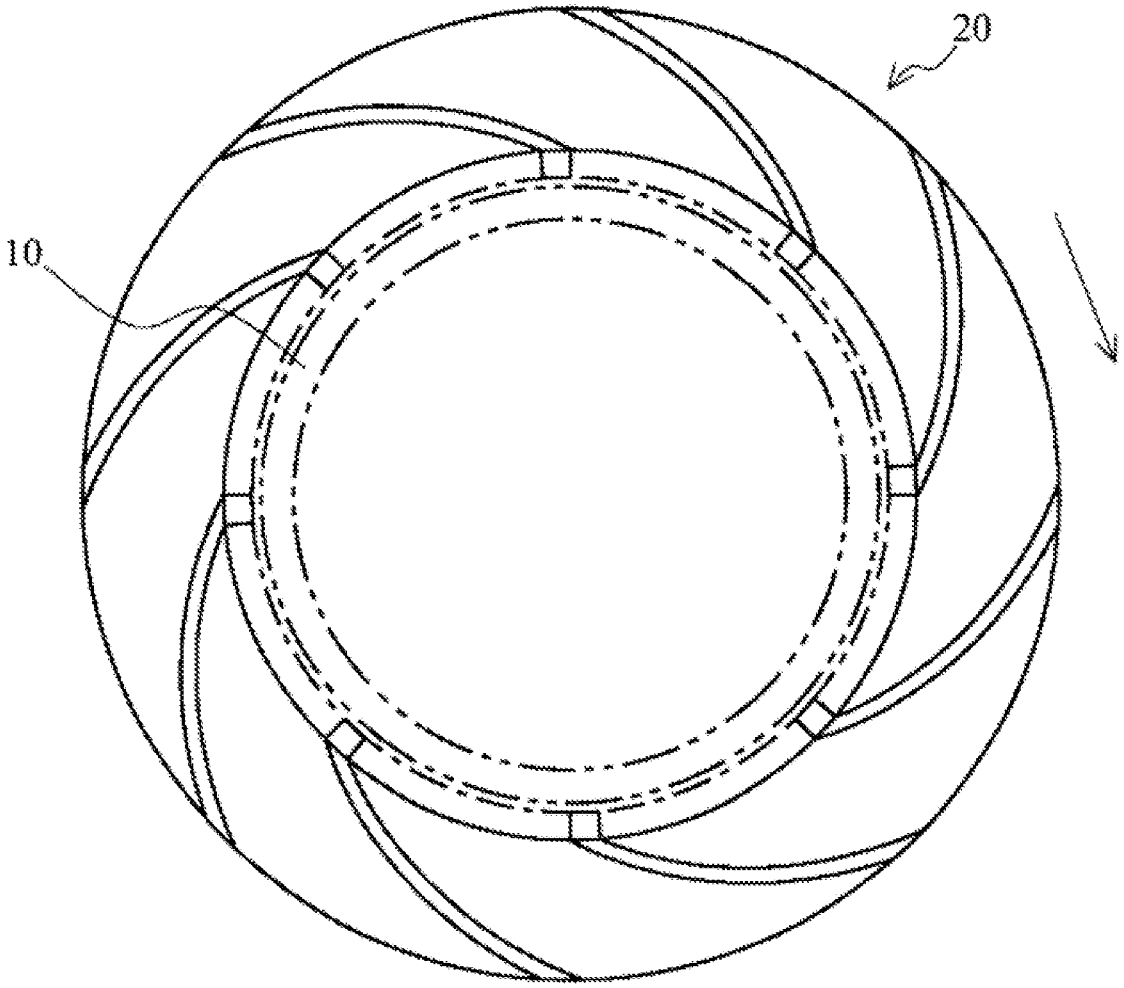
FIG. 2 is an A-A sectional view of FIG. 1 and for explaining a linked-type thread-groove spacer according to the embodiment of the present invention.
Figure 3:
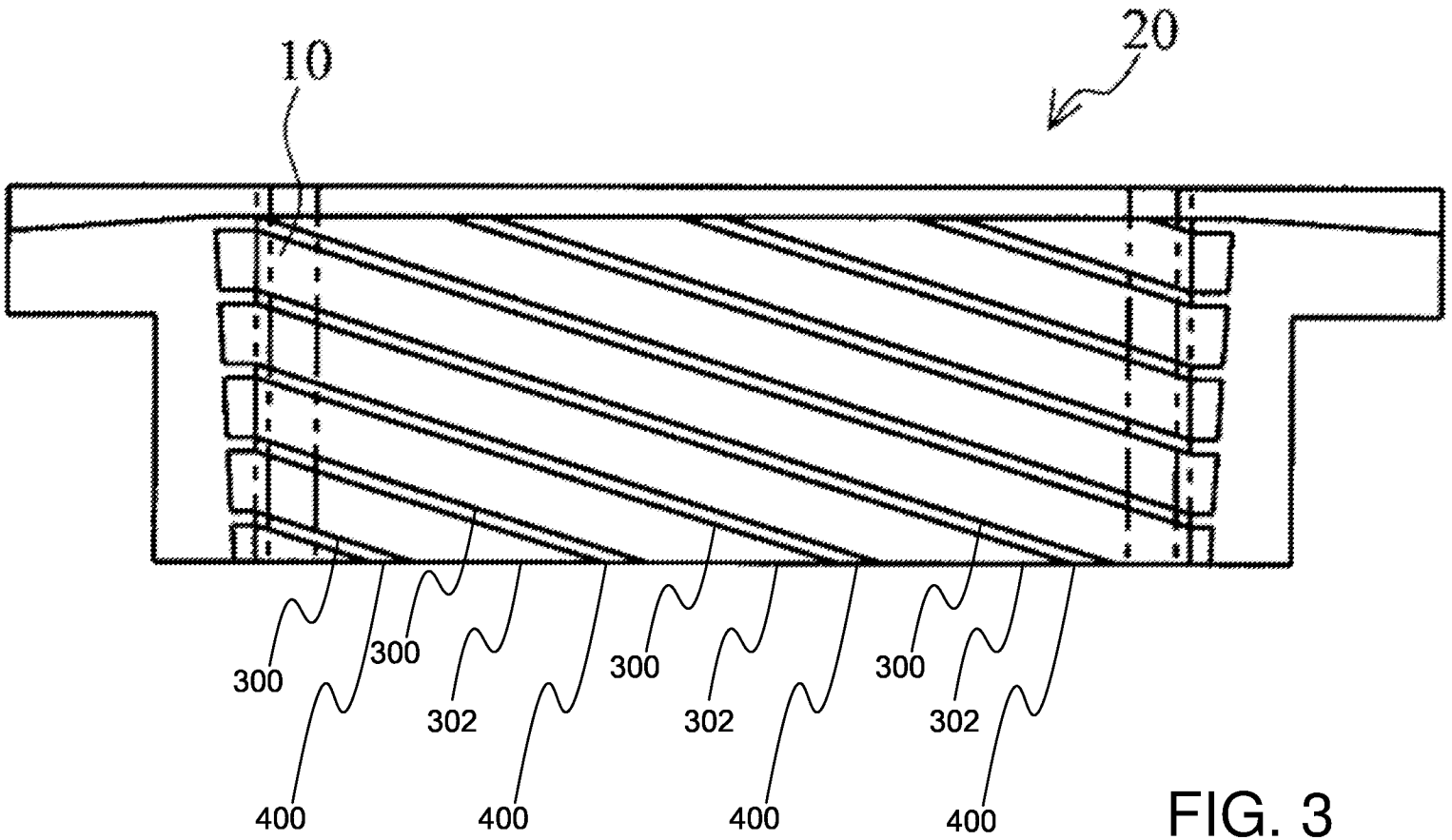
FIG. 3 is a side view of FIG. 2 and for explaining the linked-type thread-groove spacer according to the embodiment of the present invention.

FIG. 2 is an A-A sectional view of FIG. 1 and view for explaining the linked-type thread-groove spacer 20. FIG. 3 is a side view of FIG. 2. An arrow in FIG. 2 illustrates a rotating direction of the rotor cylindrical portion 10.

As shown in FIG. 1, the linked-type thread-groove spacer 20 according to this embodiment has a thread-groove spacer-shaft perpendicular portion 201 and a thread-groove spacer-shaft parallel portion 202.

The thread-groove spacer-shaft perpendicular portion 201 is constituted substantially perpendicularly (horizontally) to the axis direction of the vacuum pump 1. And a surface on the inlet port 4 side of the thread-groove spacer-shaft perpendicular portion 201 is opposed to (faced with) the rotor blade 9 of the Siegbahn portion with a predetermined clearance between them and has a spiral groove having a ridge portion and a root portion engraved. On the other hand, a surface on a side opposite to the inlet port 4 side of the thread-groove spacer-shaft perpendicular portion 201 is disposed on the base 3 side.

The thread-groove spacer-shaft parallel portion 202 is constituted substantially in parallel to the axis direction of the vacuum pump 1. And as shown in FIG. 2, in the thread-groove spacer-shaft parallel portion 202, a thread groove is formed in an inner peripheral surface which is a surface opposed to the rotor cylindrical portion 10 with a predetermined clearance between them.

In the thread-groove spacer-shaft perpendicular portion 201, the spiral groove having a perpendicular-portion ridge portion and a perpendicular-portion root portion is engraved, while in the thread-groove spacer-shaft parallel portion 202, as shown in FIG. 3, a thread groove having a parallel-portion ridge portions 300 and a-parallel-portion root portions 302 is formed. Each ridge portion 300 has an ending 400 located at the outlet of the thread-groove pump of spacer 20.

In the vacuum pump 1 according to this embodiment, by disposing the linked-type thread-groove spacer 20, the gas is compressed in a channel perpendicular to the axial direction by the thread-groove spacer-shaft perpendicular portion 201 and the rotor blade 9 (Siegbahn portion). Subsequently, the gas is further compressed in the channel in parallel with the axial direction by the thread-groove spacer-shaft parallel portion 202 and the rotor cylindrical portion 10 (thread-groove pump portion).

As described above, in the vacuum pump 1 according to this embodiment, since the linked-type thread-groove spacer 20 plays a role of connecting a gas channel from the perpendicular direction to the parallel direction with respect to the axial direction, the channel which compresses the gas can be prolonged without prolonging a length of the casing 2 in the axis direction or the length of the base 3 in the axis direction (that is, while an increase in an entire height of the vacuum pump 1 is suppressed). It is to be noted that the channel connected from the perpendicular direction to the parallel direction becomes a channel having an inverted shape of "L" in the alphabet when seen from a section in the axis direction.

It is to be noted that, in this embodiment, the thread-groove spacer-shaft perpendicular portion 201 and the thread-groove spacer-shaft parallel portion 202 of the linked-type thread-groove spacer 20 are formed integrally, but this is not limiting. For example, even if the thread-groove spacer-shaft perpendicular portion 201 and the thread-groove spacer-shaft parallel portion 202 may be constituted by separate components, there is no problem in performances if they are constituted in the inverted L-shaped type from the perpendicular direction to the parallel direction with respect to the axial direction as described above.

Figure 4:
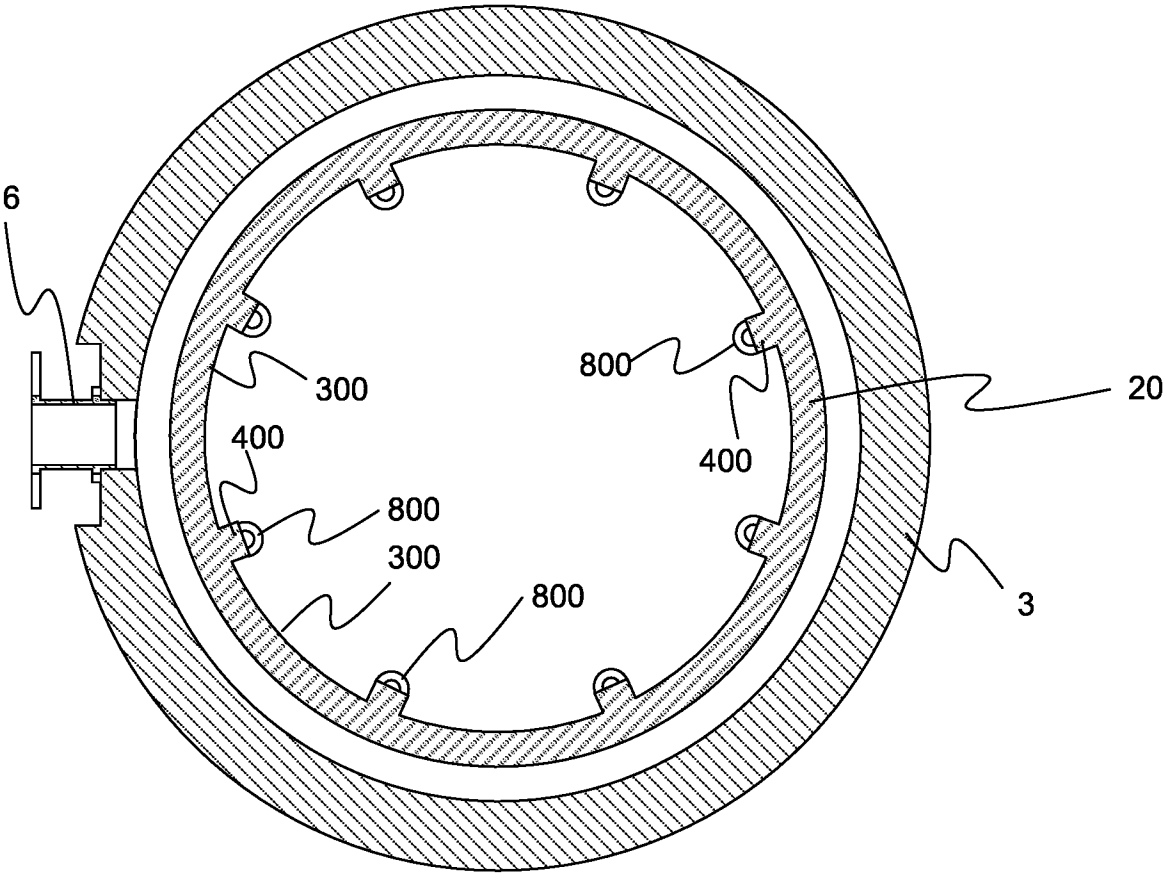
FIG. 4 is a B-B sectional view of FIG. 1 and for explaining a positional relationship between the linked-type thread-groove spacer and a stator bolt according to the embodiment of the present invention.

FIG. 4 is a B-B sectional view of FIG. 1 and view for explaining a positional relationship between the outlet of the exhaust gas of the linked-type thread-groove spacer 20 according to the embodiment of the present invention and the stator bolt 800.

In the embodiment shown in this FIG. 4, there are 8 pieces of the stator bolts 800, 8 ridge portions 300, and 8 spots of the outlets (that is, the root portions 302 of the thread groove) of the exhaust gas in the linked-type thread-groove spacer 20 and thus, endings 400 of the ridge portions 300 and the stator bolts 800 can be completely matched.

Therefore, the outlet (the root portion 302 of the thread groove) of the exhaust gas in the linked-type thread-groove spacer 20 does not interfere with the stator bolt 800 or does not badly affect the exhaust performance of the vacuum pump 1. That is, the stator bolt 800 is installed at a position not interfering with the outlet (root portion 302 of the thread groove) of the exhaust gas in the linked-type thread-groove spacer 20.

In the example shown in FIG. 4, the number of the outlets (the number of root portions in the thread groove) of the exhaust gas in the linked-type thread-groove spacer 20 matches the number of the stator bolts 800, but in actuality, these numbers do not match each other in some cases in terms of design of the vacuum pump 1.

For example, there is a case in which the number of the outlets (the number of root portions 302 of the thread groove) of the exhaust gas in the linked-type thread-groove spacer 20 is 8, and the number of the stator bolts 800 is 10. In this case, at least one of the endings 400 of ridge portions 300 of the thread groove is axially aligned with a stator bolt 800. In this way, the outlet (root portion 302 of the thread groove) of the exhaust gas in the linked-type thread-groove spacer 20 and the stator bolt 800 do not interfere in at least at the spot, and an influence of the vacuum pump 1 on the exhaust performance can be reduced.

Moreover, if the positions of the endings 400 of the ridge portions 300 of the thread groove and the stator bolt 800 are to be matched in at least at one spot in this example, in order to suppress collection of the exhaust gas in the circumferential direction by considering the exhaust performance of the vacuum pump 1, it may be so constituted that the position of the stator bolt 800 to be installed at a position which is the closest to the outlet port 6 is axially aligned with an ending 400 of one of the ridge portions 300 of the thread groove (the stator bolt 800 is not disposed in the root position 302).

It is to be noted that, if the number of outlets (the number of root portions of the thread groove) of the exhaust gas in the linked-type thread-groove spacer 20 is a multiplier of the number of stator bolts 800, all the stator bolts 800 can be installed at positions not interfering with the outlets (the root portions of the thread groove) of the exhaust gas. Specifically, it is the case in which the number of outlets (the number of the root portions of the thread groove) of the exhaust gas is 8, and the number of the stator bolts 800 is 4.

In the above-described example, the case in which the linked-type thread-groove spacer 20 is used was described, but the invention of the present application is not limited to that. By providing the thread groove on a stator side opposed to the rotor cylindrical portion 10, the present invention can be applied to a vacuum pump which compresses the exhaust gas in the axial direction.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a housing in which an inlet port or an outlet port is formed;

a stator column enclosed in the housing and surrounding various electric components;

a rotating shaft rotatably supported inside the housing so as to rotate about an axis that extends in an axial direction;

a rotating body fixed to the rotating shaft and disposed on an outer side of the stator column and rotating with the rotating shaft; and a stator portion opposing the rotating body with a predetermined clearance and having a thread groove formed; and including:

a thread-groove pump portion which exhausts a gas by a mutual action between the rotating body which is rotated and the thread groove formed in the stator portion, wherein the thread groove comprises alternating root portions and ridge portions, wherein the ridge portions extend from the root portions toward the rotating body, each ridge portion having an ending at an outlet of the thread-groove pump portion such that at least one ridge portion ending is aligned in the axial direction with a respective stator member which fixes the stator column.

2. The vacuum pump according to claim 1, wherein the respective stator member aligned with the at least one ridge portion ending is the closest stator member to the outlet port.

* * * * *